US008373626B2

(12) United States Patent
Lee

(10) Patent No.: US 8,373,626 B2
(45) Date of Patent: Feb. 12, 2013

(54) ORGANIC LIGHT EMITTING DISPLAY DEVICE HAVING DEMULTIPLEXERS

(75) Inventor: An-Su Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 322 days.

(21) Appl. No.: 12/607,045

(22) Filed: Oct. 27, 2009

(65) Prior Publication Data

US 2010/0117939 A1 May 13, 2010

(30) Foreign Application Priority Data

Nov. 7, 2008 (KR) ..... 10-2008-0110315

(51) Int. Cl.
*G09G 3/30* (2006.01)
*G09G 3/10* (2006.01)

(52) U.S. Cl. ..... 345/80; 315/169.3

(58) Field of Classification Search ..... 345/80; 315/169.3

See application file for complete search history.

(56) References Cited

U.S. PATENT DOCUMENTS 5,748,165 A * 5/1998 Kubota et al. ..... 345/96
6,157,358 A * 12/2000 Nakajima et al. ..... 345/98
6,333,729 B1 * 12/2001 Ha ..... 345/98
6,424,328 B1 * 7/2002 Ino et al. ..... 345/98
6,853,364 B2 * 2/2005 Kai et al. ..... 345/98
6,924,786 B2 * 8/2005 Hebiguchi ..... 345/98
6,961,054 B2 * 11/2005 Matsumoto ..... 345/87
6,985,130 B2 * 1/2006 Nakayoshi et al. ..... 345/98
7,053,918 B2 * 5/2006 Azami ..... 345/100
7,084,844 B2 * 8/2006 Yeo et al. ..... 345/98
7,154,488 B2 * 12/2006 Morita ..... 345/98
7,218,309 B2 * 5/2007 Uchino et al. ..... 345/100
7,301,520 B2 * 11/2007 Koyama et al. ..... 345/98

(Continued)

FOREIGN PATENT DOCUMENTS

CN 1662947 A 8/2005
JP 08-137443 5/1996

(Continued)

OTHER PUBLICATIONS

European Search Report dated Jan. 18, 2010, for corresponding European application 09175396.2, noting listed references in this IDS.

(Continued)

*Primary Examiner* — Adam J Snyder
(74) *Attorney, Agent, or Firm* — Christie, Parker & Hale, LLP

(57) ABSTRACT

An organic light emitting display device includes a display unit including a plurality of data lines, a plurality of scan lines, and pixels at crossing regions of the data lines and scan lines, wherein the plurality of data lines are arranged into a plurality of groups; a data driver for supplying data signals to the data lines; a first demultiplexer at a first side of the display unit for associating the groups to first corresponding output channels of the data driver, and for coupling the output channels to the data lines in the first corresponding groups in accordance with control signals; a second demultiplexer at a second side of the display unit opposite the first side for associating the groups to second corresponding output channels of the data driver, and for coupling the output channels to the data lines in the second corresponding groups in accordance with the control signals.

13 Claims, 3 Drawing Sheets

U.S. PATENT DOCUMENTS

| | | | | |
|---|---|---|---|---|
| 7,369,124 | B2 * | 5/2008 | Nakano et al. | 345/98 |
| 7,427,973 | B2 * | 9/2008 | Itakura et al. | 345/98 |
| 7,486,261 | B2 * | 2/2009 | Oh et al. | 345/98 |
| 7,545,394 | B2 * | 6/2009 | Nose et al. | 345/100 |
| 7,576,724 | B2 * | 8/2009 | Lin et al. | 345/98 |
| 7,619,693 | B2 * | 11/2009 | Fujioka et al. | 349/38 |
| 7,649,521 | B2 * | 1/2010 | Satoh et al. | 345/87 |
| 7,663,613 | B2 * | 2/2010 | Tanaka et al. | 345/204 |
| 7,696,966 | B2 * | 4/2010 | Sun et al. | 345/89 |
| 7,719,507 | B2 * | 5/2010 | Okumura et al. | 345/98 |
| 7,746,313 | B2 * | 6/2010 | Goto et al. | 345/100 |
| 7,760,176 | B2 * | 7/2010 | Toeda et al. | 345/90 |
| 7,800,572 | B2 * | 9/2010 | Kumeta et al. | 345/96 |
| 7,834,868 | B2 * | 11/2010 | Lee | 345/96 |
| 2002/0084966 | A1 * | 7/2002 | Yeo | 345/88 |
| 2004/0174448 | A1 * | 9/2004 | Azami | 348/280 |
| 2004/0233184 | A1 * | 11/2004 | Toriumi et al. | 345/204 |
| 2005/0168491 | A1 * | 8/2005 | Takahara et al. | 345/690 |
| 2005/0195143 | A1 * | 9/2005 | Toeda et al. | 345/88 |
| 2005/0200582 | A1 * | 9/2005 | Goto et al. | 345/89 |
| 2005/0219276 | A1 * | 10/2005 | Nose et al. | 345/690 |
| 2005/0253773 | A1 * | 11/2005 | Sekiguchi | 345/1.1 |
| 2006/0007768 | A1 * | 1/2006 | Kim | 365/205 |
| 2006/0055656 | A1 * | 3/2006 | Chung | 345/100 |
| 2006/0071884 | A1 | 4/2006 | Kim | |
| 2006/0077170 | A1 * | 4/2006 | Lee et al. | 345/103 |
| 2006/0107146 | A1 * | 5/2006 | Kim et al. | 714/727 |
| 2007/0030237 | A1 * | 2/2007 | Chen et al. | 345/100 |
| 2007/0030238 | A1 * | 2/2007 | Lin et al. | 345/100 |
| 2007/0171165 | A1 * | 7/2007 | Chuang et al. | 345/88 |
| 2008/0150874 | A1 | 6/2008 | Kida et al. | |

FOREIGN PATENT DOCUMENTS

| | | | |
|---|---|---|---|
| JP | 11-073164 | | 3/1999 |
| JP | 2003-058133 | | 2/2003 |
| JP | 2006-065328 | | 3/2006 |
| JP | 2007-226257 | | 9/2007 |
| JP | 2007-304252 | | 11/2007 |
| JP | 2008-046485 | | 2/2008 |
| KR | 10-2005-0117965 | A | 12/2005 |
| KR | 10-2006-0070341 | A | 6/2006 |
| KR | 10-2006-0117119 | A | 11/2006 |
| KR | 1020080000417 | A | 1/2008 |
| KR | 10-2008-0059856 | A | 7/2008 |

OTHER PUBLICATIONS

KIPO Office action dated May 7, 2010, in priority Korean application No. 10-2008-0110315, listing the cited references in this IDS.

Japanese Office Action dated Aug. 2, 2011, issued in Japanese Patent Application No. 2009-004034, 2 pgs.

Japanese Office action dated Apr. 3, 2012, for corresponding Japanese Patent application 2009-004034, (4 pages).

SIPO Office action dated Mar. 15, 2012, for corresponding Chinese Patent application 200910174067.6, (3 pages).

* cited by examiner

ORGANIC LIGHT EMITTING DISPLAY DEVICE HAVING DEMULTIPLEXERS

CROSS-REFERENCE TO RELATED APPLICATIONS

This application claims priority to and the benefit of Korean Patent Application No. 10-2008-0110315, filed on Nov. 7, 2008, in the Korean Intellectual Property Office, the entire content of which is incorporated herein by reference.

BACKGROUND OF THE INVENTION

1. Field of the Invention

The present invention relates to an organic light emitting display device.

2. Description of Related Art

Recently, various types of flat panel display devices have been developed which have reduced weight and volume as compared to cathode ray tubes. The flat panel display devices include liquid crystal display devices, field emission display devices, plasma display devices, organic light emitting display devices, and others.

Among the flat panel display devices, organic light emitting display devices have excellent color reproducibility, slimness, and other advantages. Accordingly, it is widely used in a variety of applications such as PDAs and MP3 players, in addition to mobile phones.

An organic light emitting display device displays images using organic light emitting diodes (OLEDs) in which luminance is determined corresponding to an amount of current input to the OLEDs.

An organic light emitting diode includes an anode electrode, a cathode electrode, and a red, green or blue light emitting layer interposed between the anode and cathode electrodes. In the organic light emitting diode, luminance of light is determined depending on an amount of current flowing between the anode and cathode electrodes.

Red, green and blue light emitting layers are formed of different materials. Thus, although the same amount of current is applied to the red, green and blue light emitting layers, their light emitting efficiencies are different. Therefore, separate gammas are applied to the red, green and blue light emitting layers.

In a conventional organic light emitting display device, a data driver is generally positioned at a side of a panel, i.e., along an upper or lower portion of the panel. Here, the data driver applies data signals to respective pixels provided in the panel. When the data driver is positioned at a lower portion of the panel, it is assumed that the data driver has 33 pins, and the 33 pins are sequentially numbered from left to right. Then, red, green and blue data are repeatedly output sequentially from a first pin to a thirty-third pin. When the data driver is positioned at an upper portion of the panel, the order of pin numbers is changed, and red, green and blue data are repeatedly output sequentially from the thirty-third pin to the first pin.

At this time, separate gammas are applied to the respective pins. When the data driving unit is positioned at the lower portion of the panel, a red gamma is applied to a first pin, a fourth pin, a seventh pin, . . . , a green gamma is applied to a second pin, a fifth pin, an eighth pin, . . . , and a blue gamma is applied to a third pin, a sixth pin, a ninth pin, . . . . That is, gammas suitable for the respective colors are applied to data output through respective lines.

However, when the same data driver is positioned at an upper portion of the panel, the order of the pin numbers is changed. Therefore, colors of data do not correspond to the gammas. That is, the red gamma is applied to the first pin, the fourth pin, the seventh pin, . . . , the green gamma is applied to the second pin, the fifth pin, the eighth pin, . . . , and the blue gamma is applied to the third pin, the sixth pin, the ninth pin, . . . . However, blue data are output through the first pin, the fourth pin, the seventh pin, . . . , green data are output through the second pin, the fifth pin, the eighth pin, . . . , and red data are output through the third pin, the sixth pin, the ninth pin, . . . . Therefore, when this data driver is positioned at the upper portion of the panel, luminance and/or white balance is compromised. Accordingly, the data driver is designed differently depending on positions of the panel in which the data driver is mounted. For this reason, manufacturing cost is increased.

SUMMARY OF THE INVENTION

Accordingly, exemplary embodiments of the present invention provide an organic light emitting display device which allows a position of a data driver mounted in the display device to be freely set.

An aspect according to an exemplary embodiment of the present invention provides an organic light emitting display device, including a display unit including a plurality of data lines, a plurality of scan lines, and pixels at crossing regions of the plurality of data lines and the plurality of scan lines, wherein the plurality of data lines are arranged into a plurality of groups; a data driver for supplying red, green and blue data signals to the plurality of data lines; a first demultiplexer at a first side of the display unit, the first demultiplexer for associating each of the groups to first corresponding output channels of the data driver, and for coupling the output channels to the data lines in the first corresponding groups in accordance with control signals; a second demultiplexer at a second side of the display unit opposite the first side, the second demultiplexer for associating each of the groups to second corresponding output channels of the data driver, and for coupling the output channels to the data lines in the second corresponding groups in accordance with the control signals; and a controller for outputting the control signals, wherein the data driver is at the first side and coupled to the first demultiplexer, or at the second side and coupled to the second demultiplexer.

The data driver may sequentially output red, green and blue data signals through the output channels during a horizontal period.

When the data driver configured to be at the first side and coupled to the first demultiplexer is positioned at the second side and coupled to the second demultiplexer, the data driver may sequentially output blue, green and red data signals through the output channels during a horizontal period.

The first demultiplexer may include first, second and third transistors, wherein the first transistor is coupled to a data line corresponding to a red pixel of the pixels from among the plurality of data lines, the second transistor is coupled to a data line corresponding to a green pixel of the pixels from among the plurality of data lines, and the third transistor is coupled to a data line corresponding to a blue pixel of the pixels from among the plurality of data lines. The second demultiplexer may include fourth, fifth and sixth transistors, wherein the fourth transistor is coupled to the data line corresponding to the red pixel, the fifth transistor is coupled to the data line corresponding to the green pixel, and the sixth transistor is coupled to the data line corresponding to the blue pixel. The first and fourth transistors may concurrently turn on and off, the second and fifth transistors may concurrently turn on and off, and the third and sixth transistors may concurrently turn on and off.

The controller may be configured to determine an order in which the first and fourth transistors, the second and fifth transistors, and the third and sixth transistors turn on and off in accordance with a position of the data driver.

The first demultiplexer may include first, second and third transistors, wherein the first transistor is coupled to a data line corresponding to a red pixel of the pixels from among the plurality of data lines, the second transistor is coupled to a data line corresponding to a green pixel of the pixels from among the plurality of data lines, and the third transistor is coupled to a data line corresponding to a blue pixel of the pixels from among the plurality of data lines. The second demultiplexer may include fourth, fifth and sixth transistors, wherein the fourth transistor is coupled to the data line corresponding to the red pixel, the fifth transistor is coupled to the data line corresponding to the green pixel, and the sixth transistor is coupled to the data line corresponding to the blue pixel. The first and sixth transistors may concurrently turn on and off, the second and fifth transistors may concurrently turn on and off, and the third and fourth transistors may concurrently turn on and off.

The controller may be configured to determine an order in which the first and sixth transistors, the second and fifth transistors, and the third and fourth transistors turn on and off in accordance with a position of the data driver.

An aspect according to another exemplary embodiment of the present invention provides an organic light emitting display device, including: a display unit including a plurality of data lines, a plurality of scan lines, and pixels at crossing regions of the plurality of data lines and the plurality of scan lines; a controller for supplying control signals; a data driver for supplying data signals to the plurality of data lines; a first demultiplexer at a first side of the display unit and connected to the plurality of data lines, the first demultiplexer configured to couple the data driver to the plurality of data lines in accordance with the control signals; and a second demultiplexer at a second side of the display unit opposite the first side and connected to the plurality of data lines, the second demultiplexer configured to couple the data driver to the plurality of data lines in accordance with the control signals; wherein the data driver is connected to the first demultiplexer or the second demultiplexer, and wherein the controller controls the first demultiplexer or the second demultiplexer to sequentially supply the data signals from the data driver to the plurality of data lines in a correct order.

Accordingly, in an organic light emitting display device and a driving method thereof according to the present invention, a position at which the data driver is mounted in the display device can be freely set.

BRIEF DESCRIPTION OF THE DRAWINGS

The accompanying drawings illustrate exemplary embodiments of the present invention, and, together with the description, serve to explain the principles of the present invention.

DETAILED DESCRIPTION OF EXEMPLARY EMBODIMENTS

Figure 1:
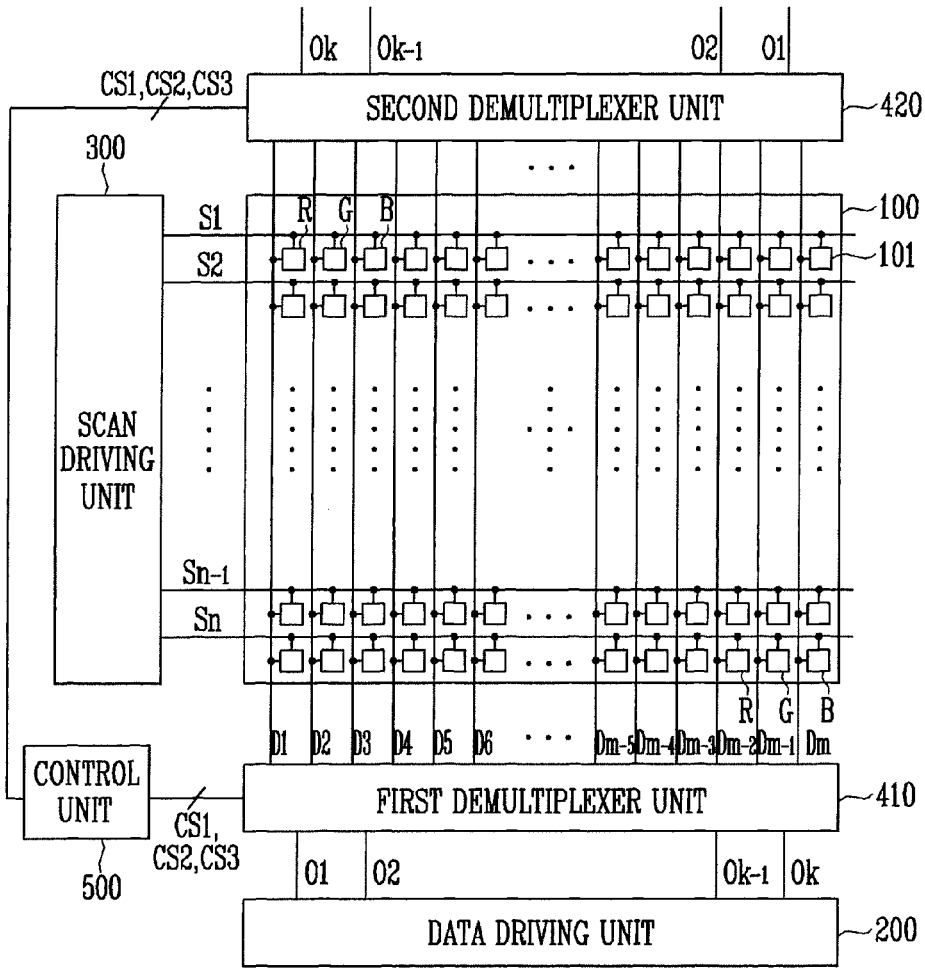
FIG. 1 is a schematic block diagram showing the structure of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via one or more additional elements. Further, some of the elements that are not essential to the complete understanding of the invention are omitted for clarity. Also, like reference numerals refer to like elements throughout.

FIG. 1 is a schematic block diagram showing the structure of an organic light emitting display device according to an embodiment of the present invention.

Referring to FIG. 1, the organic light emitting display device includes a display unit 100, a data driver 200, a scan driver 300, a first demultiplexer unit 410, a second demultiplexer unit 420 and a controller 500.

A plurality of pixels 101 are arranged in the display unit 100, and each of the pixels 101 includes an organic light emitting diode (not shown). The display unit 100 includes n scan lines S1, S2, . . . , Sn−1 and Sn, and m data lines D1, D2, . . . , Dm−1 and Dm. Here, the n scan lines S1, S2, . . . , Sn−1 and Sn extend in a row direction and supply scan signals. The m data lines D1, D2, . . . , Dm−1 and Dm extend in a column direction and supply data signals.

The display unit 100 is driven by receiving first and second power sources. In the display unit 100, current flows through the organic light emitting diodes by utilizing scan signals, data signals, light emission signals and the first and second power sources, so that the display unit 100 emits light to display images. The plurality of pixels includes red, green and blue sub-pixels, R, G and B.

The data driver 200 generates data signals using image signals (R, G and B data signals) having red, green and blue components. The data driver 200 applies data signals output through output channels O1, O2, . . . , Ok−1 and Ok to the display unit 100. Here, the output channels O1, O2, . . . , Ok−1 and Ok are connected to the data lines D1, D2, . . . , Dm−1 and Dm of the display unit 100. The data driver 200 sequentially outputs three data signals from each output channel. That is, red, green and blue data signals are sequentially output from each output channel of the data driver 200, so that the number of output channels of the data driver 200 can be decreased.

The data driver 200 is positioned above or below the display unit 100. When the data driver 200 is positioned below the display unit 100 as shown in FIG. 1, the data driver 200 is coupled to the display unit 100 through the first demultiplexer unit 410. When the data driver 200 is positioned above the display unit 100, the data driver 200 is coupled to the display unit 100 through the second demultiplexer 420.

In the embodiment of the present invention, the data driver 200 positioned below the display unit 100 will be described as an example.

The scan driver 300 generates scan signals. The scan driver 300 is connected to the scan lines S1, S2, . . . , Sn−1 and Sn, and supplies a scan signal to specific rows of the display unit 100. A data signal output from the data driver 200 is supplied to a pixel 101 receiving the scan signal, and a voltage corresponding to the data signal is applied to the pixel 101.

Each of the first and second demultiplexer units includes a plurality of demultiplexers. The respective demultiplexers divide the plurality of data lines into a plurality of groups, and each of the groups is coupled to an output channel of the data driver 200 through a demultiplexer. In other words, an output channel of the data driver 200 is coupled to a demultiplexer so that the output channel is coupled to three data lines through the demultiplexer. Data signals of three different colors are output from the output channel, and each of the data signals is supplied to a corresponding data line by the demultiplexer.

Operations of the first and second demultiplexer units 410 and 420 will now be described. When red, green and blue data signals are output from an output channel of the data driver 200, the first or second demultiplexer unit 410 or 420 time-divisionally controls a connection sequence between the plurality of data lines and the output channels in accordance with timing of the output data signals, so that the red, green and blue data signals output from the output channel are transmitted to data lines coupled to red, green and blue pixels, respectively. Therefore, although red, green and blue gammas are individually used, red data are provided only to red pixels, green data are provided only to green pixels, and blue data are provided only to blue pixels, depending on operation of the first or second demultiplexer 410 or 420. Accordingly, luminance or white balance is not lost due to the mismatch of gammas.

The controller 500 controls the first and second demultiplexer units 410 and 420. The controller 500 generates control signals depending on whether the data driver 200 is positioned above or below the display unit 100. Accordingly, the controller 500 controls data signals output from the data driver 200 to be applied to data lines coupled to the pixels.

Hereinafter, a connection of the display unit 100, the first and second demultiplexer units 410 and 420 and the data driver 200 will be described in detail.

Each of the plurality of pixels constituting the display unit 100 includes three sub-pixels, i.e., red, green and blue sub-pixels, R, G and B. The respective sub-pixels R, G and B are coupled to data lines and receive data signals through the data lines, respectively.

The respective pixels 101 have red, green and blue sub-pixels, R, G and B repeatedly positioned from left to right of the display unit 100.

The data driver 200 is coupled to the display unit 100 in one of two configurations. In a first configuration, the output channels O1, O2, . . . , Ok−1 and Ok of the data driver 200 sequentially output red, green and blue data signals. In a second configuration, the output channels O1, O2, . . . , Ok−1 and Ok of the data driver 200 sequentially output blue, green and red data signals.

In the first configuration, the data driver 200 is positioned below the display unit 100. In the second configuration, the data driver 200 is positioned above the display unit 100. Here, since the data driver 200 is designed to be positioned above the pixel unit 100 in the second configuration, the order of the output channels numbered from left to right is reversed as compared to the first configuration.

In the first configuration, the output channels of the data driver 200 are arranged from left to right in the order of a first output channel, a second output channel, . . . , a (k−1)-th output channel and a k-th output channel, O1, O2, . . . , Ok−1 and Ok. In the display unit 100, red, green and blue pixels are repeatedly positioned from left to right of the display unit 100. Therefore, if red, green and blue data are sequentially output from an output channel, the first demultiplexer unit 410 allows the red, green and blue data to be respectively provided to red, green and blue pixels, R, G and B.

However, in the second configuration, the operation of the data driver 200 is reversed as compared to the first configuration. Therefore, the output channels of the data driver 200 are arranged from left to right directions in the order of a k-th output channel, a (k−1)-th output channel, . . . , a second output channel and a first output channel, Ok, Ok−1, . . . , O2 and O1. If red, green and blue data are sequentially output from an output channel, the second demultiplexer unit 420 allows the red, green and blue data to be respectively provided to red, green and blue pixels, R, G and B. Further, if blue, green and red data are sequentially output from an output channel, the second demultiplexer unit 420 allows the blue, green and red data to be respectively provided to blue, green and red pixels, B, G and R through control of the controller 500.

That is, red, green and blue data output from an output channel are respectively provided to red, green and blue pixels R, G and B by an operation of either the first or second demultiplexer unit 410 or 420, regardless of the position of the data driver 200.

Therefore, red, green and blue gammas are correctly applied to the red, green and blue data regardless of the position of the data driver 200. Accordingly, suitable gammas are respectively applied to data signals and pixels, so that white balance is not lost.

Figure 2:
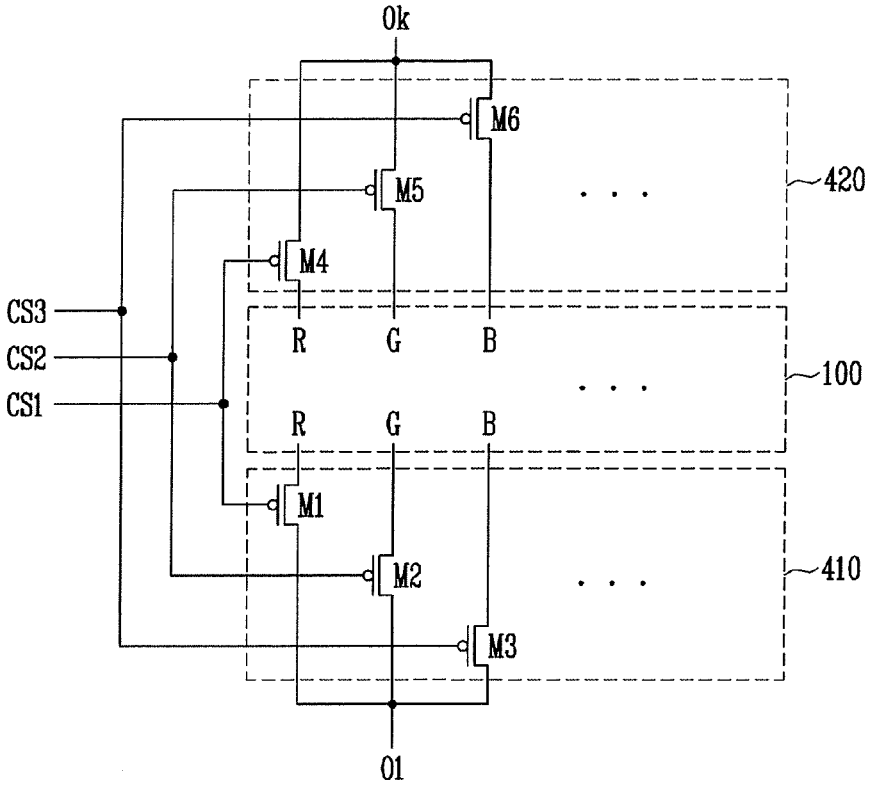
FIG. 2 shows a first embodiment of a connection of first and second demultiplexer units employed in the organic light emitting display device according to aspects of the present invention.
Figure 3:
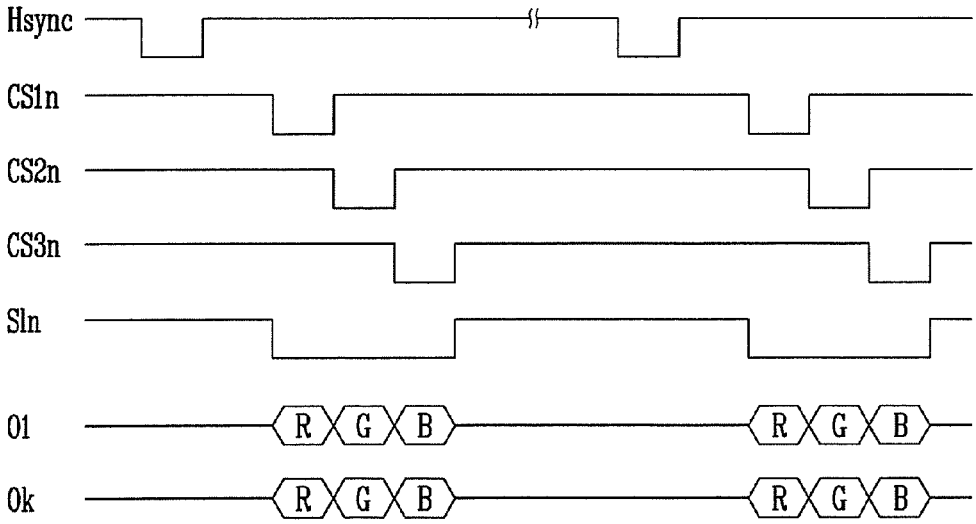
FIG. 3 is a timing diagram showing signals input to the organic light emitting display device of FIG. 2.

FIG. 2 shows a first embodiment of a connection of the first and second demultiplexer units employed in the organic light emitting display device according to aspects of the present invention. FIG. 3 is a timing diagram showing signals input to the organic light emitting display device of FIG. 2. The connection of the first and second demultiplexer units 410 and 420 will be described below with reference to FIGS. 2 and 3.

In the first embodiment, red, green and blue data are sequentially output from an output channel regardless of the position of the data driver 200.

The first demultiplexer unit 410 is formed below the display unit 100 and includes first to third transistors, M1, M2 and M3.

A first electrode of the first transistor M1 is coupled to an output channel O1 through which data signals are output, and a second electrode of the first transistor M1 is coupled to a data line coupled to a red pixel R. A gate electrode of the first transistor M1 is coupled to a first control line CS1 through which a first control signal CS1*n* is supplied.

A first electrode of the second transistor M2 is coupled to the output channel O1, and a second electrode of the second transistor M2 is coupled to a data line coupled to a green pixel G. A gate electrode of the second transistor M2 is coupled to a second control line CS2 through which a second control signal CS2*n* is supplied.

A first electrode of the third transistor M3 is the output channel O1, and a second electrode of the third transistor M3 is coupled to a data line coupled to a blue pixel B. A gate electrode of the third transistor M3 is coupled to a third control line CS3 through which a third control signal CS3*n* is supplied.

The second demultiplexer unit 420 is formed above the display unit 100 and includes fourth to sixth transistors, M4, M5 and M6.

A first electrode of the fourth transistor M4 is coupled to an output channel Ok through which data signals are output, and a second electrode of the fourth transistor M4 is coupled to a data line coupled to a red pixel R. A gate electrode of the fourth transistor M4 is coupled to the first control line CS1 through which the first control signal CS1*n* is supplied.

A first electrode of the fifth transistor M5 is coupled to the output channel Ok, and a second electrode of the fifth transistor M5 is coupled to a data line coupled to a green pixel G. A gate electrode of the fifth transistor M5 is coupled to the second control line CS2 through which the second control signal CS2*n* is supplied.

A first electrode of the sixth transistor M6 is coupled to the output channel Ok, and a second electrode of the sixth transistor M6 is coupled to a data line coupled to a blue pixel B. A gate electrode of the sixth transistor M6 is coupled to the third control line CS3 through which the third control signal CS3*n* is supplied.

The first and second electrodes of each of the transistors are source and drain electrodes. If the first electrode is a source electrode, the second electrode is a drain electrode. If the first electrode is a drain electrode, the second electrode is a source electrode.

Operations of the first and second demultiplexer unit 410 and 420 will now be described. The first, second and third control signals CS1*n*, CS2*n* and CS3*n* sequentially become low states when a scan signal SIn maintains a low state, which occurs after a horizontal synchronization signal Hsync becomes a low state. After that, the first, second and third control signals CS1*n*, CS2*n* and CS3*n* sequentially become low states again when a scan signal SIn again becomes a low state, after a subsequent horizontal synchronization signal Hsync becomes a low state. The data signals are divided into red, green and blue data signals, and each of the data signals is supplied while the corresponding one of the control signals maintains a low state.

First, when the first control signal CS1*n* becomes a low state, the first and fourth transistors M1 and M4 are turned on. At this time, a red data signal is output to the output channels O1 and Ok of the data driver 200. If the data driver 200 is positioned below the display unit 100, the red data signal is provided to a red pixel R through a data line via the first transistor M1. If the data driver 200 is positioned above the display unit 100, the red data signal is provided to a red pixel R through a data line via the fourth transistor M4.

When the second control signal CS2*n* becomes a low state, the second and fifth transistors M2 and M5 are turned on. At this time, a green data signal is output to the output channels O1 and Ok of the data driver 200. If the data driver 200 is positioned below the display unit 100, the green data signal is provided to a green pixel G through a data line via the second transistor M2. If the data driver 200 is positioned above the display unit 100, the green data signal is provided to a green pixel G through a data line via the fifth transistor M5.

When the third control signal CS3*n* becomes a low state, the third and sixth transistors M3 and M6 are turned on. At this time, a blue data signal is output to the output channels O1 and Ok of the data driver 200. If the data driver 200 is positioned below the display unit 100, the blue data signal is provided to a blue pixel G through a data line via the third transistor M3. If the data driver 200 is positioned above the display unit 100, the blue data signal is provided to a blue pixel G through a data line via the sixth transistor M6.

Figure 4:
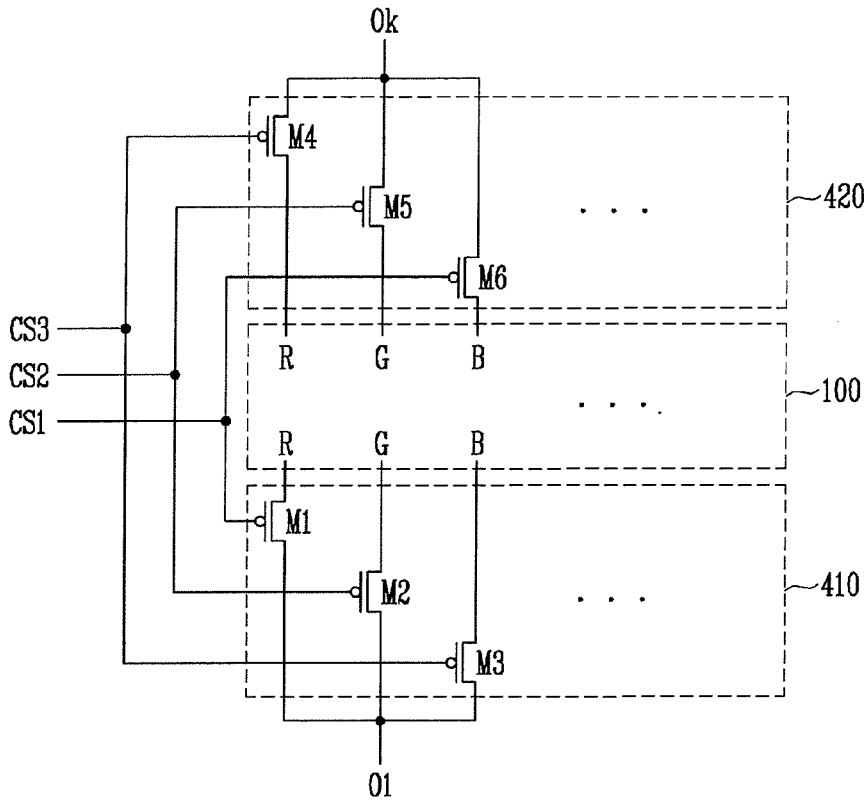
FIG. 4 shows a second embodiment of the connection of the first and second demultiplexer units employed in the organic light emitting display device according to aspects of the present invention.
Figure 5:
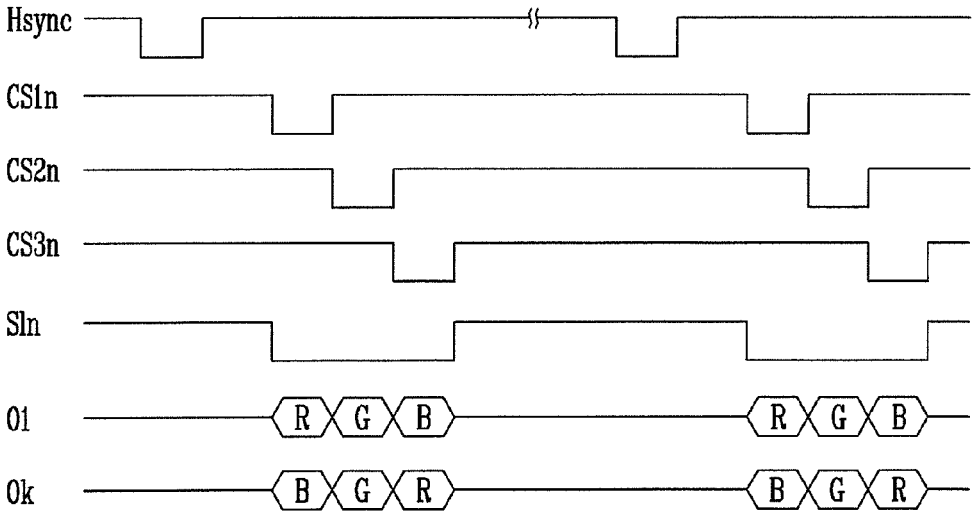
FIG. 5 is a timing diagram showing signals input to the organic light emitting display device of FIG. 4.

FIG. 4 shows a second embodiment of the connection of the first and second demultiplexer units employed in the organic light emitting display device according to aspects of the present invention. FIG. 5 is a timing diagram showing signals input to the organic light emitting display device of FIG. 4. The connection of the first and second demultiplexer units 410 and 420 will be described below with reference to FIGS. 4 and 5.

The order of red, green and blue data output from an output channel is reversed depending on whether the data driver 200 is positioned above or below the display unit 100.

The first demultiplexer unit 410 is formed below the display unit 100 and includes first to third transistors, M1, M2 and M3.

A first electrode of the first transistor M1 is coupled to an output channel O1 through which data signals are output, and a second electrode of the first transistor M1 is coupled to a data line coupled to a red pixel R. A gate electrode of the first transistor M1 is coupled to a first control line CS1 through which a first control signal CS1*n* is supplied.

A first electrode of the second transistor M2 is coupled to the output channel O1, and a second electrode of the second transistor M2 is coupled to a data line coupled to a green pixel G. A gate electrode of the second transistor M2 is coupled to a second control line CS2 through which a second control signal CS2*n* is supplied.

A first electrode of the third transistor M3 is coupled to the output channel O1, and a second electrode of the third transistor M3 is coupled to a data line coupled to a blue pixel B. A gate electrode of the third transistor M3 is coupled to a third control line CS3 through which a third control signal CS3*n* is supplied.

The second demultiplexer unit 420 is formed above the display unit 100 and includes fourth to sixth transistors, M4, M5 and M6.

A first electrode of the fourth transistor M4 is coupled to an output channel Ok through which data signals are output, and a second electrode of the fourth transistor M4 is coupled to a data line coupled to a red pixel R. A gate electrode of the fourth transistor M4 is coupled to the third control line CS3 through which the third control signal CS3*n* is supplied.

A first electrode of the fifth transistor M5 is coupled to the output channel Ok, and a second electrode of the fifth transistor M5 is coupled to a data line coupled to a green pixel G. A gate electrode of the fifth transistor M5 is coupled to the second control line CS2 through which the second control signal CS2*n* is supplied.

A first electrode of the sixth transistor M6 is coupled to the output channel Ok, and a second electrode of the sixth transistor M6 is coupled to a data line coupled to a blue pixel B. A gate electrode of the sixth transistor M6 is coupled to the first control line CS1 through which the first control signal CS1*n* is supplied.

Operations of the first and second demultiplexer unit 410 and 420 will now be described. The first, second and third control signals CS1*n*, CS2*n* and CS3*n* sequentially become low states when a scan signal SIn maintains a low state, which occurs after a horizontal synchronization signal Hsync becomes a low state. After that, the first, second and third control signals CS1*n*, CS2*n* and CS3*n* sequentially become low states again when a scan signal SIn again becomes a low state, after a subsequent horizontal synchronization signal Hsync becomes a low state. The data signals are divided into red, green and blue data signals, and each of the data signals is supplied while the corresponding one of the control signals maintains a low state.

First, when the first control signal CS1*n* becomes a low state, the first and sixth transistors M1 and M6 are turned on. At this time, if the data driver 200 is positioned below the display unit 100, a red data signal is output to the output channel O1 of the data driver 200. If the data driver 200 is positioned above the display unit 100, a blue data signal is output to the output channel Ok of the data driver 200. Therefore, if the data driver 200 is positioned below the display unit 100, the red data signal is provided to a red pixel R through a data line via the first transistor M1. If the data driver 200 is positioned above the display unit 100, the blue data is provided to a blue pixel B through a data line via the sixth transistor M6.

When the second control signal CS2*n* becomes a low state, the second and fifth transistors M2 and M5 are turned on. At this time, a green data signal is output to the output channels O1 and Ok of the data driver 200, regardless of the position of the data driver 200. If the data driver 200 is positioned below the display unit 100, the green data signal is provided to a green pixel G through a data line via the second transistor M2. If the data driver 200 is positioned above the display unit 100, the green data signal is provided to a green pixel G through a data line via the fifth transistor M5.

When the third control signal CS3*n* becomes a low state, the third and fourth transistors M3 and M4 are turned on. At this time, if the data driver 200 is positioned below the display unit 100, a blue data signal is output to the output channel O1 of the data driver 200. If the data driver 200 is positioned above the display unit 100, a red data signal is output to the output channel Ok of the data driver 200. Therefore, if the data driver 200 is positioned below the display unit 100, the blue data signal is provided to a blue pixel B through a data line via the third transistor M3. If the data driver 200 is positioned above the display unit 100, the red data signal is provided to a red pixel R through a data line via the fourth transistor M4.

While the present invention has been described in connection with certain exemplary embodiments, it is to be understood that the invention is not limited to the disclosed embodiments, but instead is intended to cover various modifications and equivalent arrangements included within the spirit and scope of the appended claims, and equivalents thereof.

What is claimed is:

1. An organic light emitting display device, comprising:

a display unit comprising a plurality of data lines, a plurality of scan lines, and pixels at crossing regions of the plurality of data lines and the plurality of scan lines, wherein the plurality of data lines are arranged into a plurality of groups;

a data driver for supplying red, green and blue data signals to the plurality of data lines;

a first demultiplexer at a first side of the display unit, the first demultiplexer for associating each of the groups to a first corresponding output channel of the data driver positioned at the first side, and for coupling the output channels to the data lines in accordance with control signals;

a second demultiplexer at a second side of the display unit opposite the first side, the second demultiplexer for associating each of the groups to a second corresponding output channel of the data driver positioned at the second side, and for coupling the output channels to the data lines in accordance with the control signals; and a controller for outputting the control signals according to whether the data driver is positioned at the first side or the second side of the display unit and the data signals, wherein the data driver is only positioned at the first side and coupled to the first demultiplexer, or only positioned at the second side and coupled to the second demultiplexer, and wherein all of the pixels are located in the display unit and between the first demultiplexer and the second demultiplexer.

2. The organic light emitting display device of claim 1, wherein the data driver sequentially outputs red, green and blue data signals through the output channels during a horizontal period.

3. The organic light emitting display device of claim 1, wherein when the data driver configured to be at the first side and coupled to the first demultiplexer is positioned at the second side and coupled to the second demultiplexer, the data driver sequentially outputs blue, green and red data signals through the output channels during a horizontal period.

4. The organic light emitting display device of claim 1, wherein:

the first demultiplexer comprises first, second and third transistors, wherein the first transistor is coupled to a data line corresponding to a red pixel of the pixels from among the plurality of data lines, the second transistor is coupled to a data line corresponding to a green pixel of the pixels from among the plurality of data lines, and the third transistor is coupled to a data line corresponding to a blue pixel of the pixels from among the plurality of data lines; and the second demultiplexer comprises fourth, fifth and sixth transistors, wherein the fourth transistor is coupled to the data line corresponding to the red pixel, the fifth transistor is coupled to the data line corresponding to the green pixel, and the sixth transistor is coupled to the data line corresponding to the blue pixel; and wherein the first and fourth transistors concurrently turn on and off, the second and fifth transistors concurrently turn on and off, and the third and sixth transistors concurrently turn on and off.

5. The organic light emitting display device of claim 4, wherein the controller is configured to determine an order in which the first and fourth transistors, the second and fifth transistors, and the third and sixth transistors turn on and off in accordance with a position of the data driver.

6. The organic light emitting display device of claim 1, wherein:

the first demultiplexer comprises first, second and third transistors, wherein the first transistor is coupled to a data line corresponding to a red pixel of the pixels from among the plurality of data lines, the second transistor is coupled to a data line corresponding to a green pixel of the pixels from among the plurality of data lines, and the third transistor is coupled to a data line corresponding to a blue pixel of the pixels from among the plurality of data lines; and the second demultiplexer comprises fourth, fifth and sixth transistors, wherein the fourth transistor is coupled to the data line corresponding to the red pixel, the fifth transistor is coupled to the data line corresponding to the green pixel, and the sixth transistor is coupled to the data line corresponding to the blue pixel; and wherein the first and sixth transistors concurrently turn on and off, the second and fifth transistors concurrently turn on and off, and the third and fourth transistors concurrently turn on and off.

7. The organic light emitting display device of claim 6, wherein the controller is configured to determine an order in which the first and sixth transistors, the second and fifth transistors, and the third and fourth transistors turn on and off in accordance with a position of the data driver.

8. The organic light emitting display device of claim 1, wherein the first demultiplexer and the second demultiplexer are each configured to supply data signals to all of the plurality of data lines.

9. An organic light emitting display device, comprising:

a display unit comprising a plurality of data lines, a plurality of scan lines, and pixels at crossing regions of the plurality of data lines and the plurality of scan lines;

a data driver for supplying data signals to the plurality of data lines; a controller for supplying control signals according to whether the data driver is positioned at a first side or a second side of the display unit and the data signals;

a first demultiplexer at the first side of the display unit and connected to the plurality of data lines, the first demultiplexer configured to couple the data driver positioned at the first side to the plurality of data lines in accordance with the control signals; and a second demultiplexer at the second side of the display unit opposite the first side and connected to the plurality of data lines, the second demultiplexer configured to couple the data driver positioned at the second side to the plurality of data lines in accordance with the control signals;

wherein the data driver is only positioned at the first side and coupled to the first demultiplexer, or only positioned at the second side and coupled to the second demultiplexer, wherein the controller controls the first demultiplexer or the second demultiplexer to sequentially supply the data signals from the data driver to the plurality of data lines in a correct order, wherein the data driver sequentially supplies red, green and blue data signals, and the first demultiplexer or the second demultiplexer is configured to supply the red data signals to a data line corresponding to a red pixel of the pixels from among the plurality of data lines, to supply the green data signals to a data line corresponding to a green pixel of the pixels from among the plurality of data lines, and to supply the blue data signals to a data line corresponding to a blue pixel of the pixels from among the plurality of data lines, and wherein all of the pixels are located in the display unit and between the first demultiplexer and the second demultiplexer.

10. The organic light emitting display device of claim 9, wherein the first demultiplexer comprises a first transistor coupled to the data line corresponding to the red pixel, a second transistor coupled to the data line corresponding to the green pixel, and a third transistor coupled to the data line corresponding to the blue pixel; and wherein the second demultiplexer comprises a fourth transistor coupled to the data line corresponding to the red pixel, a fifth transistor coupled to the data line corresponding to the green pixel, and a sixth transistor coupled to the data line corresponding to the blue pixel.

11. The organic light emitting display device of claim 10, wherein gate electrodes of the first and fourth transistors are coupled together, gate electrodes of the second and fifth transistors are coupled together, and gate electrodes of the third and sixth transistors are coupled together, and wherein the control signals are supplied to the respective gate electrodes for controlling the corresponding transistors.

12. The organic light emitting display device of claim 10, wherein gate electrodes of the first and sixth transistors are coupled together, gate electrodes of the second and fifth transistors are coupled together, and gate electrodes of the third and fourth transistors are coupled together, and wherein the control signals are supplied to the respective gate electrodes for controlling the corresponding transistors.

13. The organic light emitting display device of claim 9, wherein the first demultiplexer and the second demultiplexer are each configured to supply data signals to all of the plurality of data lines.

* * * * *